US005306127A

United States Patent [19]

Kinney

[11] Patent Number: 5,306,127

[45] Date of Patent: Apr. 26, 1994

[54] FLUID PUMP WITH AXIALLY ADJUSTABLE GEARS

[76] Inventor: Gerald R. Kinney, 1820 Fairview, Wichita, Kans. 67203

[21] Appl. No.: 27,431

[22] Filed: Mar. 8, 1993

[51] Int. Cl.[5] ..... F01C 21/16

[52] U.S. Cl. ..... 418/21; 418/24; 418/28; 418/29

[58] Field of Search ..... 418/20, 21, 24, 28, 418/29

[56] References Cited

U.S. PATENT DOCUMENTS 1,742,215 1/1930 Pigott ..... 418/21

3,669,577 6/1972 Swanson ..... 418/21

FOREIGN PATENT DOCUMENTS 2551803 3/1985 France ..... 418/21

*Primary Examiner*—Richard A. Bertsch

*Assistant Examiner*—Charles G. Freay

*Attorney, Agent, or Firm*—Leon Gilden

[57] ABSTRACT

A fluid pump is arranged to employ cooperating gears that are arranged for axial displacement relative to one another, whereupon a volumetric chamber positioned between a surrounding housing and one of a plurality of inter-nesting first and second cylindrical housings permits displacement of the first and second cylindrical housings towards one another that in turn effects axial displacement of the gears relative to one another to control inter-engagement and associated volumetric displacement relative to the gear structure.

2 Claims, 4 Drawing Sheets 10
2
36
11
18
15
16
14
13
17
11a
38
2

23
12
5
31
22a
35
11
19
13
22
21a
20
27
30
27a
25
36
18
14
28
38
29
28a
19a
39
26
21
37
32
20a
24
5

FLUID PUMP WITH AXIALLY ADJUSTABLE GEARS

BACKGROUND OF THE INVENTION

1. Field of the Invention

The field of invention relates to fluid pump structure, and more particularly pertains to a new and improved fluid pump apparatus arranged to provide for variable facing displacement of pump gears relative to one another to control volumetric flow through the pump structure.

2. Description of the Prior Art

Fluid pumps of various types have been utilized throughout the prior art such as exemplified in the U.S. Pat. Nos. 4,934,913; 4,830,952; 4,898,525; 5,062,776; and 5,076,770.

The instant invention attempts to direct the use of a pump structure providing for axial displacement of pump gears to vary the facing relationship of the pump gears relative to one another in a cooperating manner and thereby alter and vary volumetric flow through the associated pump and in this respect, the present invention substantially fulfills this need.

SUMMARY OF THE INVENTION

In view of the foregoing disadvantages inherent in the known types of fluid pump apparatus now present in the prior art, the present invention provides a fluid pump apparatus wherein the same is directed to permit axial displacement and associated engagement of confronting fluid pump gears relative to one another. As such, the general purpose of the present invention, which will be described subsequently in greater detail, it to provide a new and improved fluid pump apparatus which has all the advantages of the prior art fluid pump apparatus and none of the disadvantages.

To attain this, the present invention provides a fluid pump arranged to employ cooperating gears that are arranged for axial displacement relative to one another, whereupon a volumetric chamber positioned between a surrounding housing and one of a plurality of inter-nesting first and second cylindrical housings permits displacement of the first and second cylindrical housing towards one another that in turn effects axial displacement of the gears relative to one another to control inter-engagement and associated volumetric displacement relative to the gear structure.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contri7 bution to the art may be better appreciated. There are, of course, additional features of the invention that will be described hereinafter and which will form the subject matter of the claims appended hereto. Those skilled in the art will appreciated that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fluid pump apparatus which has all the advantages of the prior art fluid pump apparatus and none of the disadvantages.

It is another object of the present invention to provide a new and improved fluid pump apparatus which may be easily and efficiently manufactured and marketed.

It is a further object of the present invention to provide a new and improved fluid pump apparatus which is of a durable and reliable construction.

An even further object of the present invention is to provide a new and improved fluid pump apparatus which is susceptible of a low cost of manufacture with regard to both materials and labor, and which accordingly is then susceptible of low prices of sale to the consuming public, thereby making such fluid pump apparatus economically available to the buying public.

Still yet another object of the present invention is to provide a new and improved fluid pump apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings amd descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
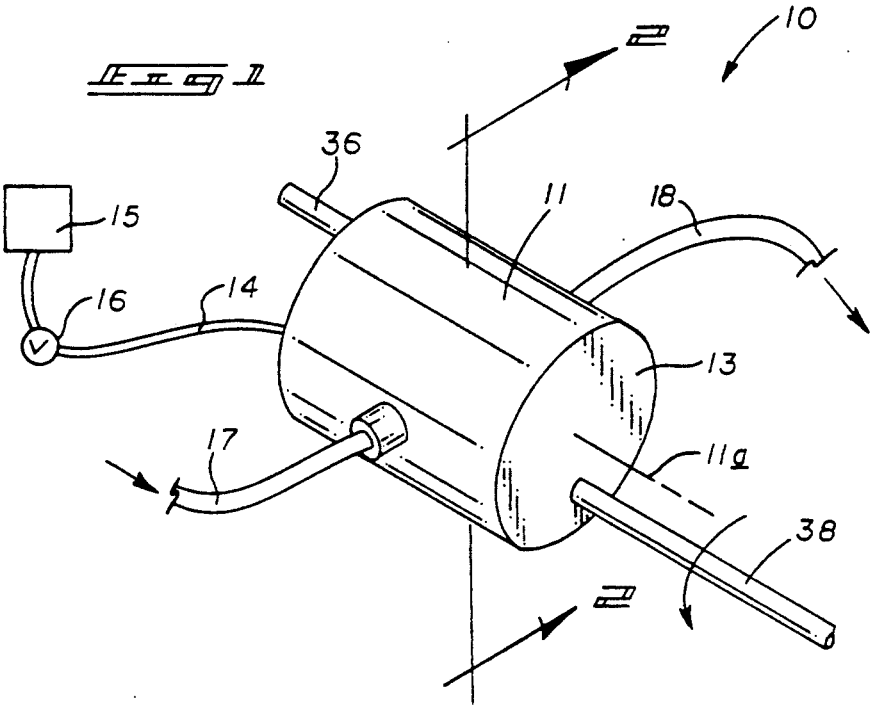
FIG. 1 is an isometric illustration of the invention.
Figure 2:
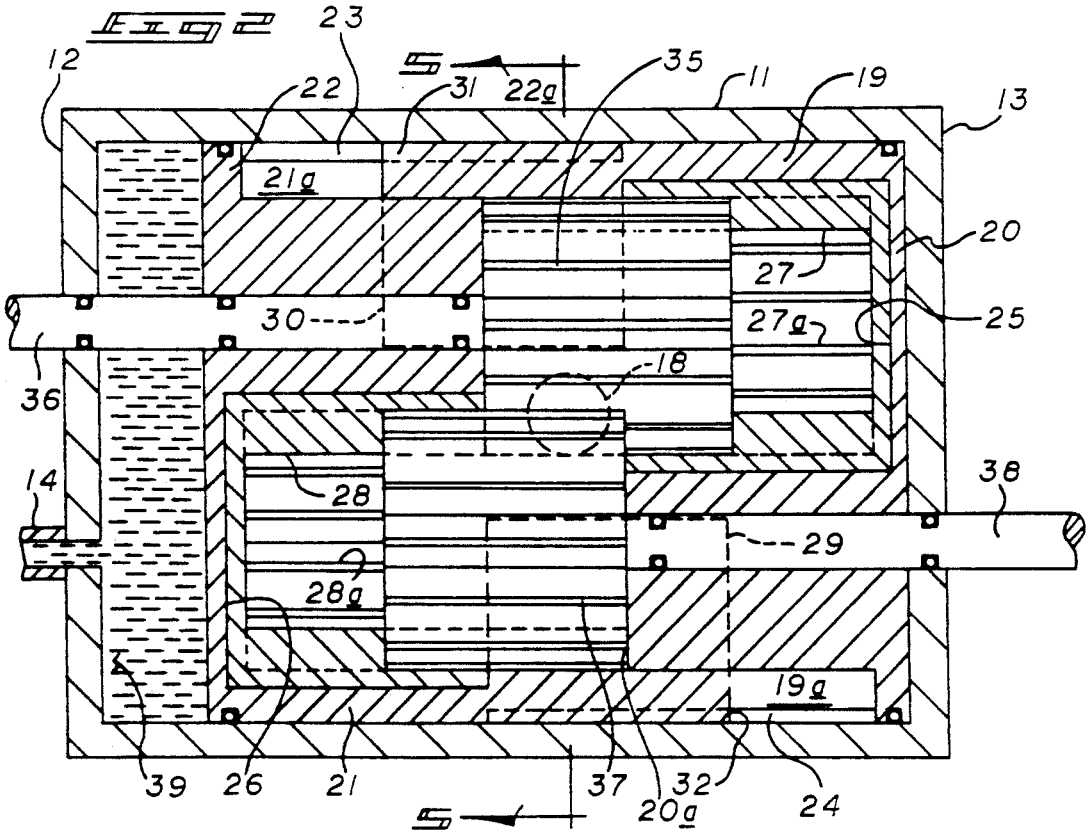
FIG. 2 is an orthographic view, taken along the lines 2—2 of FIG. 1 in the direction indicated by the arrows.

With reference now to the drawings, and in particular to FIGS. 1 to 8 thereof, a new and improved fluid pump apparatus embodying the principles and concepts of the present invention and generally designated by the reference numeral 10 will be described.

More specifically, the fluid pump apparatus 10 of the instant invention essentially comprises a primary cylindrical housing symmetrically oriented about an axis 11*a*, having a cylindrical side wall 11 and a first end wall 12 spaced from and parallel a second end wall 13. A fluid means is provided to include a hydraulic pressure conduit 14 is directed into the first end wall 12, wherein a fluid pressure source 15 such as a pump or a bleed-off from an outlet conduit 18 of the apparatus 10 directed through the side wall 11 is provided in communication with a valve 16 directing fluid into the hydraulic pressure conduit 14. An inlet conduit 17 is directed into the cylindrical side wall 11 diametrically opposed through the cylindrical side wall 11 relative to the outlet conduit 18.

Figure 3:
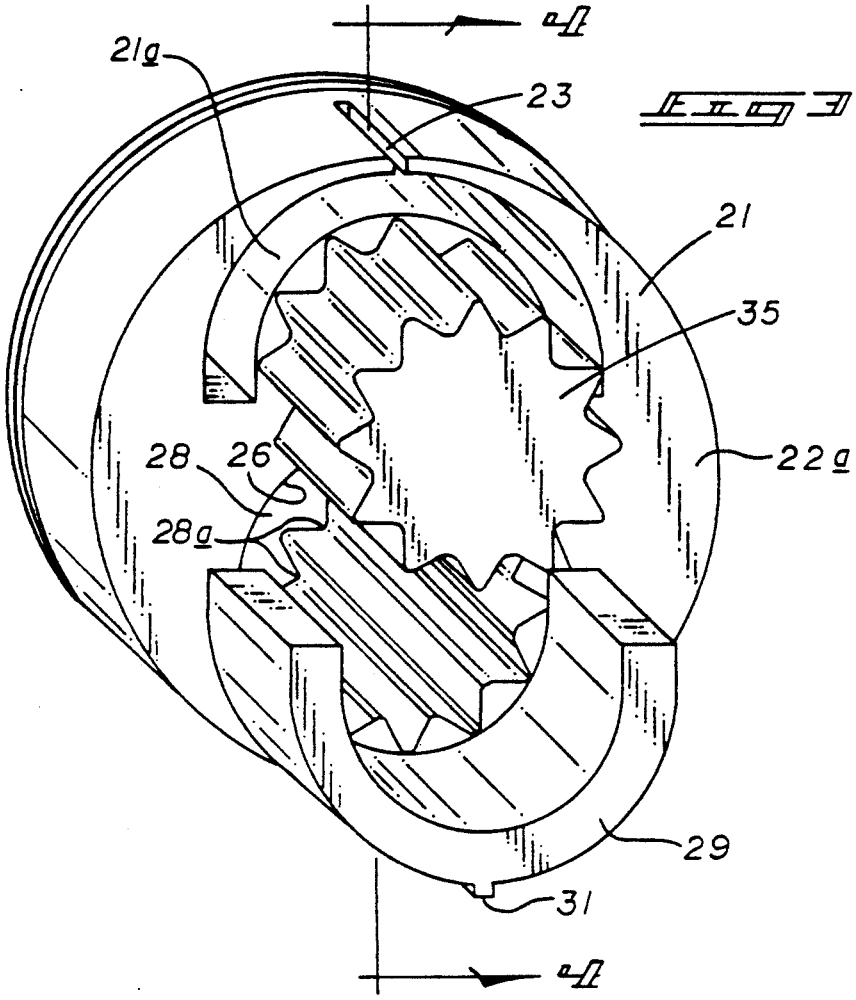
FIG. 3 is an isometric illustration of the second cylindrical housing mounting the first shield and the second pump gear.
Figure 4:
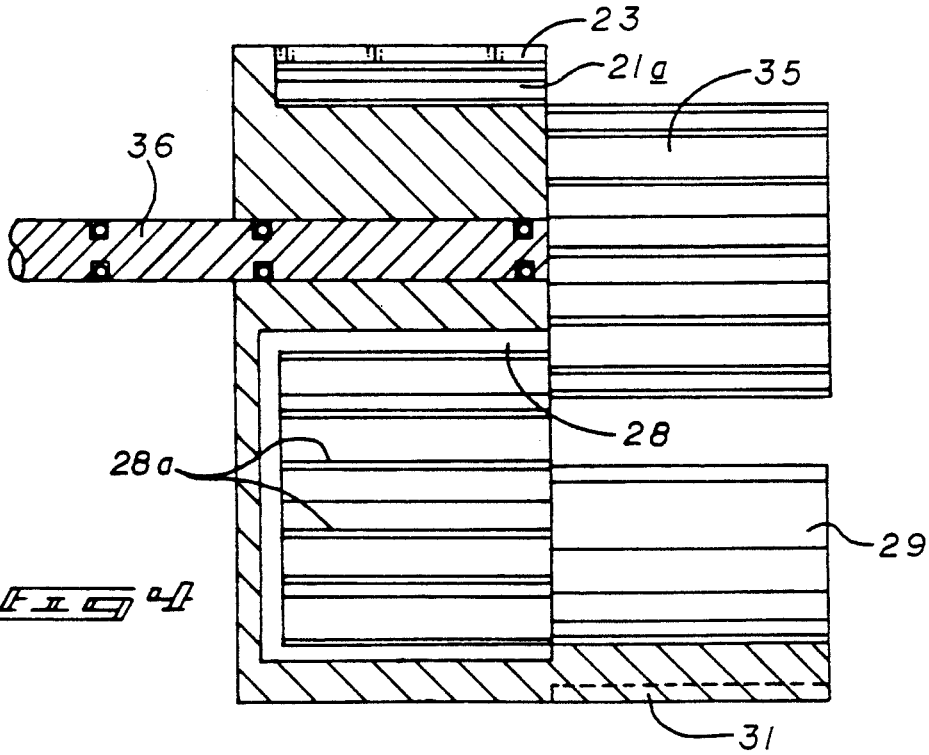
FIG. 4 is an orthographic view, taken along the lines 4—4 of FIG. 3 in the direction indicated by the arrows.
Figure 5:
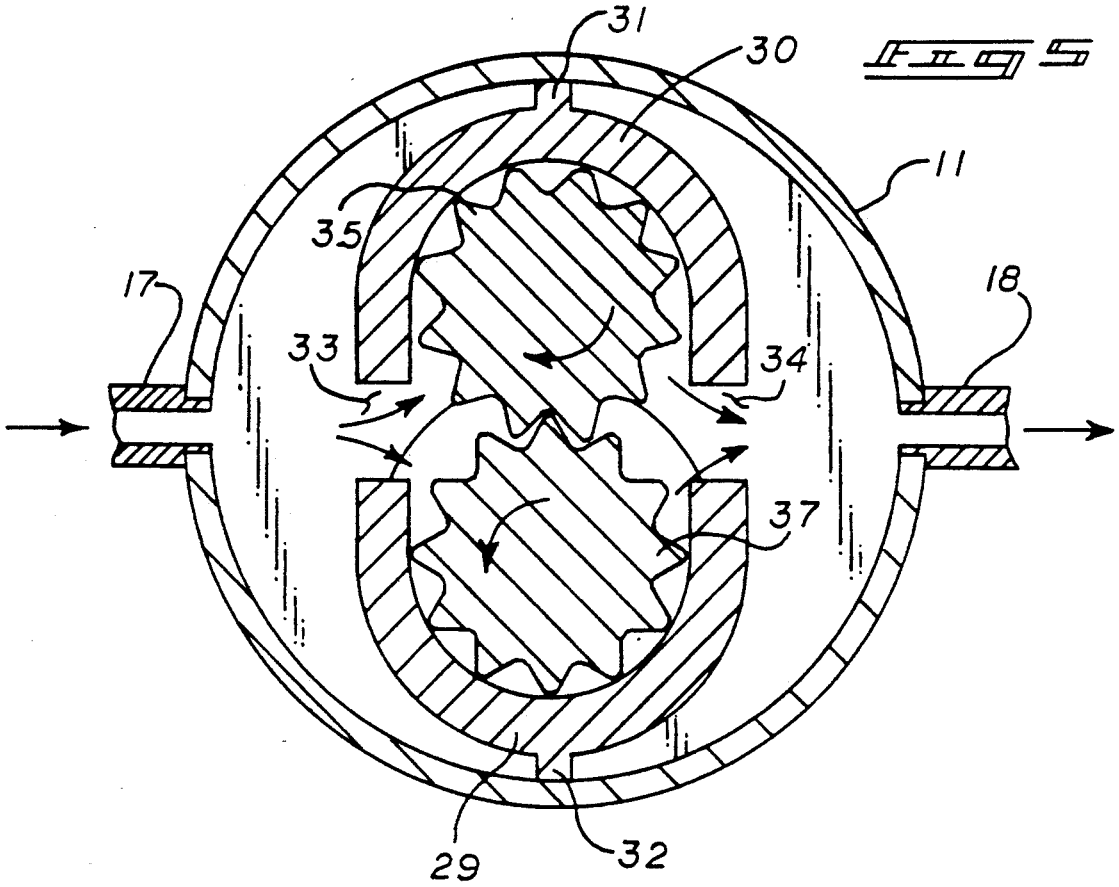
FIG. 5 is an orthographic view, taken along the lines 5—5 of FIG. 2 in the direction indicated by the arrows.
Figure 6:
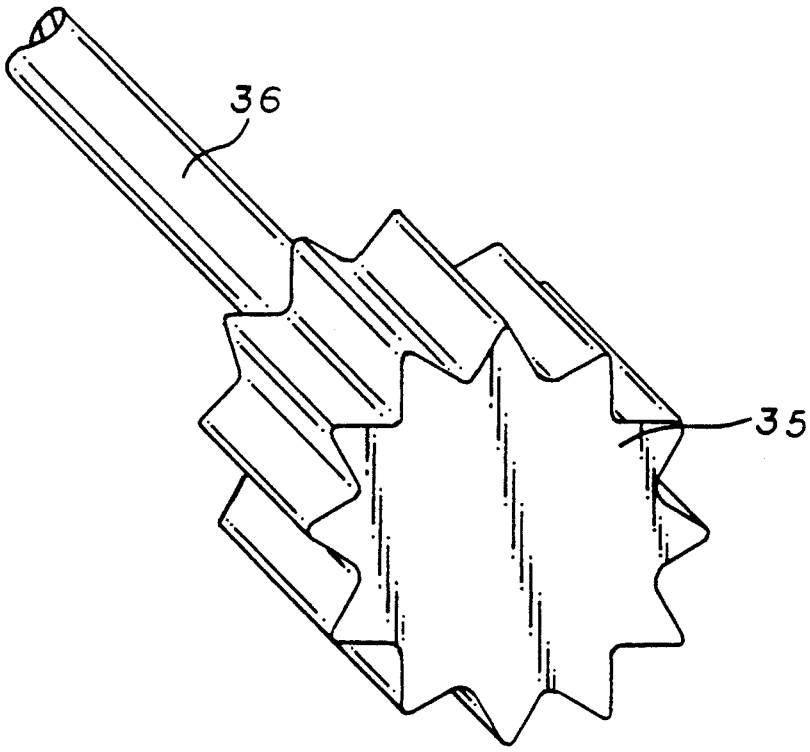
FIG. 6 is an isometric illustration of an individual pump gear of the invention.
Figure 7:
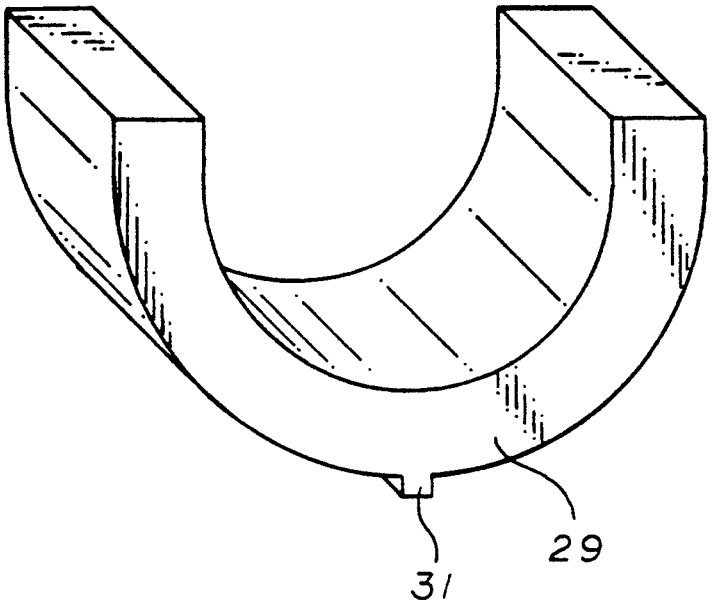
FIG. 7 is an isometric illustration of a typical shield structure as employed by the invention.
Figure 8:
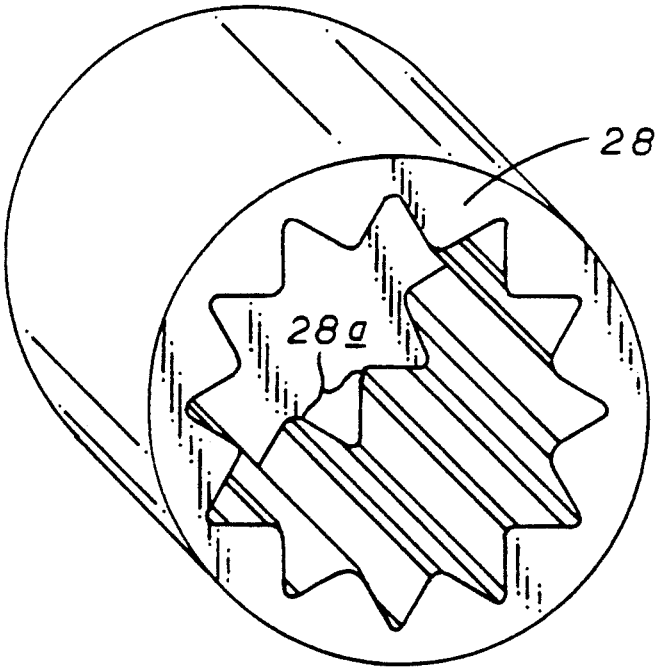
FIG. 8 is an isometric illustration of a tubular sleeve complementarily receiving the gear in cooperating engagement with the gear ribs therewithin.

Respective first and second cylindrical housings 19 and 21 are reciprocatably mounted and coaxially aligned along the axis 11*a* arranged for telescoping reception relative towards one another. The first housing includes a first housing first end wall 20 spaced from and parallel a first housing second end wall 20*a*, wherein the second housing 21 includes a second housing first end wall 22 spaced from and parallel a second housing second end wall 22*a*. A second housing slot 23 is directed into the second housing (see FIG. 3), wherein a similar such slot such as a first housing slot 24 is directed into the first housing 19. A first C-shaped shield 29 is fixedly mounted to the second housing at the second housing second end wall 22*a* and received within a first housing C-shaped cavity 19*a* directed into the first housing second end wall 20*a*. Similarly, a second C-shaped shield 30 fixedly mounted to the first housing 19 and more specifically to the first housing second end wall 20*a* is received within a second housing C-shaped cavity 21*a* directed into the second housing 21 through the second housing second end wall 22*a*. The C-shaped configuration is indicated in FIG. 3 relative to the second housing, wherein it is understood that the complementarily configured first housing is provided with a like C-shaped housing cavity to receive the first C-shaped shield 29. The first and second slots 24 and 23 are arranged to receive the respective second and first ribs 32 and 31 of the first and second respective C-shaped shields 29 and 30. Respective first and second housing cylindrical cavities 25 and 26 each parallel and offset relative to the axis 11*a* are directed into the respective first and second housings 19 and 21 respectively into the respective first and second housing second end walls 20*a* and 22*a* respectively. The first and second cylindrical cavities 25 and 26 rotatably receive first and second tubular sleeves 27 and 28 having respective first and second parallel gear ribs 27*a* and 28*a* directed within the tubular sleeves to complementarily receive the respective second and first pump gears 35 and 37. The first and second pump gears 35 and 37 include respective second and first pump gear shafts 36 and 38 that rotatably project through the respective second and first housings and through the respective second and first end walls 12 and 13. The second and first pump gear shafts 36 and 38 are arranged for rotary displacement, and wherein at least the first pump gear shaft 38 is mounted in operative communication to a suitable drive means. The second gear pump shaft 36 may be employed in a manner to effect input to a suitable control means such as a speed vs. time controller and the like. Further, as indicated in FIG. 5 for example, respective first and second gaps 33 and 34 are ori7 ented between the respective first and second C-shaped shields 29 and 30 in adjacency to the respective inlet and outlet conduits 17 and 18, wherein the shield structure provides for pressurized displacement of fluid from the inlet conduit 17 directed through the outlet conduit 18 in a pressurized manner. The surface engagement of the respective second and first pump gear shafts 35 and 37 is effected through the fluid and volumetric filling of the fluid control chamber 39 (see FIG. 5) receiving fluid through the hydraulic pressure conduit 14 and oriented between the first end wall 12 of the primary cylindrical housing and the second housing first end wall 22.

Accordingly, axial displacement and engagement of the pump gears 35 and 37 permits volumetric control of fluid directed through the apparatus in a variable manner.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as being new and desired to be protected by Letters Patent of the United States is as follows:

1. A fluid pump apparatus, comprising, a primary cylindrical housing symmetrically oriented about a housing axis, with the primary cylindrical housing including a cylindrical side wall and a first end wall spaced from and parallel to a second end wall, and a hydraulic pressure conduit directed into the pri7 mary cylindrical housing through the first end wall, and an inlet conduit directed into the cylindrical side wall and an outlet conduit directed into the cylindrical side wall, wherein the inlet conduit and the outlet conduit are diametrically opposed relative to one another through the cylindrical side wall, and a fixed first cylindrical housing mounted within the primary cylindrically housing in communication with the second end wall, and a second cylindrical housing reciprocatably mounted within the primary cylindrical housing and arranged in a facing relationship relative to the first cylindrical housing, wherein a fluid control chamber is oriented between the second cylindrical housing and the first end wall, and the first cylindrical housing having a first housing cylindrical cavity radially displaced relative to the housing axis, and the second cylindrical housing having a second housing cylindrical cavity di7 rected into the second cylindrical housing radially displaced relative to the housing axis, wherein the first cylindrical housing included a first housing first end wall positioned in adjacency to the primary housing second end wall, and the first cylindrical housing having a first housing second end wall, including the first housing cylindrical cavity directed therethrough, and wherein the second cylindrical housing includes a second housing first end wall arranged in a facing relationship relative to the primary cylindrical housing first end wall, with the fluid control chamber oriented therebetween, with the second cylindrical housing having a second cylindrical housing second end wall in facing parallel relationship relative to the first cylindrical housing second end wall, with the second cylindrical housing second end wall including the second cylindrical cavity directed therein, wherein the first cylindrical cavity and the second cylindrical cavity are arranged in a spaced parallel relationship relative to one another, with the first cylindrical cavity including a first tubular sleeve having first gear ribs therewithin, and the second cylindrical cavity having a second tubular sleeve having second gear ribs therewithin, and a second pump gear received slidably within the first tubular sleeve, and a first pump gear slidably received within the second tubular sleeve, wherein the first tubular sleeve and the second tubular sleeve are arranged for rotative engagement relative to the first cylindrical cavity and the second cylindrical cavity respectively, and the second pump gear includes a second pump gear shaft directed through the primary cylindrical housing first end wall, and the first pump gear including a first pump gear shaft directed through the primary cylindrical housing second end wall, wherein fluid control means in fluid communication with the hydraulic pressure conduit is arranged for providing for selective volumetric filling of the fluid control chamber to provide for axial displacement of the second pump gear relative to the first pump gear to effect selective pressurizing of fluid from the inlet conduit to the outlet conduit, and the second cylindrical housing second end wall includes a first C-shaped shield fixedly mounted thereto, wherein the first housing second end wall includes a first C-shaped cavity to receive the first C-shaped shield complementarily therewithin, and a second C-shaped shield is orthogonally and fixedly mounted to the first housing second end wall, and wherein the second housing second end wall includes a second housing C-shaped cavity to receive the second C-shaped shield slidably therewithin, wherein the first C-shaped shield and the second C-shaped shield include a first gap in facing relationship relative to the inlet conduit, and the first C-shaped shield and the second C-shaped shield include a second gap oriented in facing relationship relative to the outlet conduit.

2. An apparatus as set forth in claim 1 wherein the first housing includes a first housing slot, the second housing having a second housing slot, with the first C-shaped shield including a first rib received within the first housing slot, and the second C-shaped shield having a second rib slidably received within the first housing slot, wherein the first housing slot and the second housing slot are in sliding relationship relative to the first rib and the second rib respectively and maintain alignment of the first housing relative to the second housing.

* * * * *